US010821333B2

(12) United States Patent
Stubben et al.

(10) Patent No.: US 10,821,333 B2
(45) **Date of Patent: *Nov. 3, 2020**

(54) GOLF CLUB FACE INSERT

(71) Applicant: Callaway Golf Company, Carlsbad, CA (US)

(72) Inventors: Eric D. Stubben, Encinitas, CA (US); David Handy, Carlsbad, CA (US); Brett Carter, Oceanside, CA (US); Craig E. Abbott, Klamath Falls, OR (US); Augustin W. Rollinson, Solana Beach, CA (US); Sean Toulon, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/902,222

(22) Filed: Jun. 15, 2020

(65) Prior Publication Data

US 2020/0306599 A1 Oct. 1, 2020

Related U.S. Application Data

(63) Continuation of application No. 16/601,404, filed on Oct. 14, 2019, now Pat. No. 10,688,349, which is a continuation-in-part of application No. 16/370,685, filed on Mar. 29, 2019, now Pat. No. 10,456,634, which is a continuation of application No. (Continued)

(51) Int. Cl.

| | |
|---|---|
| ***A63B 53/04*** | (2015.01) |
| ***A63B 53/00*** | (2015.01) |
| ***A63B 60/50*** | (2015.01) |

(52) U.S. Cl.

CPC ..... *A63B 53/04* (2013.01); *A63B 53/007* (2013.01); *A63B 53/0487* (2013.01); *A63B 53/0408* (2020.08); *A63B 53/0416* (2020.08); *A63B 53/0445* (2020.08); *A63B 60/50* (2015.10); *A63B 2209/00* (2013.01)

(58) Field of Classification Search

CPC ... A63B 53/04; A63B 53/007; A63B 53/0487; A63B 53/0408; A63B 53/0416; A63B 53/0045; A63B 60/50; A63B 2209/00

USPC ..... 473/324–350, 287–292

See application file for complete search history.

(56) References Cited

U.S. PATENT DOCUMENTS 1,705,997 A * 3/1929 Williams ..... A63B 53/0466 473/329

2,005,401 A * 6/1935 Storz ..... A63B 53/047 473/331

(Continued)

*Primary Examiner* — Sebastiano Passaniti

(74) *Attorney, Agent, or Firm* — Rebecca Hanovice; Michael Catania; Sonia Lari

(57) ABSTRACT

A resilient face insert for a golf club head, preferably a putter head, is disclosed herein. In particular, the face insert comprises a plurality of hinge features spaced from a striking surface to ensure consistent ball speed across the striking surface. Each hinge feature comprises a tab portion that is spaced from the striking surface by a stem portion and that extends parallel to the striking surface, and is angled with respect to a horizontal y-axis. The orientation of hinge features with respect to the y-axis varies across the face, which reduces sidespin from mishits and produces consistent topspin regardless of impact location of a golf ball on the face insert.

20 Claims, 7 Drawing Sheets

Related U.S. Application Data

16/059,898, filed on Aug. 9, 2018, now Pat. No. 10,245,476, which is a continuation of application No. 15/796,431, filed on Oct. 27, 2017, now Pat. No. 10,052,529, which is a continuation-in-part of application No. 15/706,761, filed on Sep. 18, 2017, now Pat. No. 9,981,161, which is a continuation of application No. 15/189,774, filed on Jun. 22, 2016, now Pat. No. 9,776,051.

(60) Provisional application No. 62/247,589, filed on Oct. 28, 2015.

(56) References Cited

U.S. PATENT DOCUMENTS 4,792,139 A * 12/1988 Nagasaki ..... A63B 53/04 473/342
5,354,059 A * 10/1994 Stuff ..... A63B 53/0487 473/329
5,690,561 A * 11/1997 Rowland ..... A63B 60/00 473/330
6,110,057 A * 8/2000 McKinnon ..... A63B 53/0487 473/313
D431,853 S * 10/2000 Antonious ..... D21/759
6,193,615 B1 * 2/2001 Hirota ..... A63B 53/047 473/329
6,224,497 B1 * 5/2001 Antonious ..... A63B 53/0487 473/330
6,257,994 B1 * 7/2001 Antonious ..... A63B 53/0487 473/331
6,277,033 B1 * 8/2001 Krumme ..... A63B 60/00 473/342
6,849,004 B2 * 2/2005 Lindsay ..... A63B 53/0487 473/330
7,278,926 B2 * 10/2007 Frame ..... A63B 53/0487 473/329
7,278,928 B2 * 10/2007 Newman ..... A63B 53/047 473/342
7,367,898 B2 * 5/2008 Hawkins ..... A41D 13/015 473/329
7,445,561 B2 * 11/2008 Newman ..... A63B 53/047 473/330
7,461,726 B2 * 12/2008 Hawkins ..... A41D 13/0518 188/371
7,465,240 B2 * 12/2008 Frame ..... A63B 53/0487 473/329
7,708,653 B2 * 5/2010 Hawkins ..... F41H 1/02 473/329
7,713,139 B1 * 5/2010 Stites ..... A63B 53/0487 473/329
7,824,278 B2 * 11/2010 Miyamichi ..... A63B 53/0487 473/329
8,109,841 B2 * 2/2012 Miyamichi ..... A63B 53/0487 473/340
8,292,754 B2 * 10/2012 Snyder ..... A63B 53/04 473/251
8,371,958 B2 * 2/2013 Treadwell ..... A63B 53/04 473/331
9,474,945 B2 * 10/2016 Fossum ..... A63B 53/0466
D800,857 S * 10/2017 Abbott ..... D21/759
9,776,051 B1 * 10/2017 Abbott ..... A63B 53/0487
9,981,161 B2 * 5/2018 Abbott ..... A63B 60/50
10,052,529 B1 * 8/2018 Abbott ..... A63B 53/04
10,245,476 B2 * 4/2019 Abbott ..... A63B 53/04
10,456,634 B2 * 10/2019 Abbott ..... A63B 53/0487
10,688,349 B2 * 6/2020 Stubben ..... A63B 53/0429

* cited by examiner

GOLF CLUB FACE INSERT

CROSS REFERENCES TO RELATED APPLICATIONS

The present application is a continuation of U.S. patent application Ser. No. 16/601,404, filed on Oct. 14, 2019, and issued on Jun. 23, 2020, as U.S. Pat. No. 10,688,349, which is a continuation-in-part of U.S. patent application Ser. No. 16/370,685, filed on Mar. 29, 2019, and issued on Oct. 29, 2019, as U.S. Pat. No. 10,456,634, which is a continuation of U.S. patent application Ser. No. 16/059,898, filed on Aug. 9, 2018, and issued on Apr. 2, 2019, as U.S. Pat. No. 10,245,476, which is a continuation of U.S. patent application Ser. No. 15/796,431, filed on Oct. 27, 2017, and issued on Aug. 21, 2018, as U.S. Pat. No. 10,052,529, which is a continuation-in-part of U.S. patent application Ser. No. 15/706,761, filed on Sep. 18, 2017, and issued on May 29, 2018, as U.S. Pat. No. 9,981,161, which is a continuation of U.S. patent application Ser. No. 15/189,774, filed on Jun. 22, 2016, and issued on Oct. 3, 2017, as U.S. Pat. No. 9,776,051, which claims priority to U.S. Provisional Patent Application No. 62/247,589, filed on Oct. 28, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club face insert comprising a plurality of hinge features, each comprising a stem portion and a suspended tab portion, extending from and disposed across a striking surface.

Description of the Related Art

The prior art discloses many different types of face inserts for golf club heads, including putters, that are intended to improve face performance. For example, U.S. Pat. No. 7,278,928 discloses a striking face with a plurality of solid geometric protrusions, U.S. Pat. No. 7,824,278 discloses a putter face with a plurality of pillar-shaped bodies made of a material having a higher rigidity than a golf ball, U.S. Pat. No. 8,109,841 discloses a face with a plurality of microscopic protrusions having a stiffness higher than that of a golf ball, and U.S. Pat. No. 8,371,958 discloses a golf club face with a plurality of pyramidal shaped extensions protruding therefrom. There is, however, still a need for a putter face that optimizes performance and increases the consistency of ball speed across the face.

BRIEF SUMMARY OF THE INVENTION

The present invention is directed to a putter face technology that corrects the starting line for off-center putts, uses launch angle to correct mishits, and produce consistent topspin regardless of impact location across the face.

One aspect of the present invention is a putter comprising a body comprising a top portion, a sole portion, a toe side, a heel side, a rear side, and a face side with a recess, and a face insert comprising a striking plate, a geometric center, and a backing portion, wherein the face insert is disposed within the recess so that at least a portion of the striking plate is exposed, wherein a horizontal y-axis extends in a heel side to toe side direction parallel with the face side and a ground plane, a vertical z-axis extends perpendicular to the y-axis from the sole portion to the top portion through the geometric center, and a horizontal x-axis extends perpendicular to both the y- and z-axes from the face side to the rear side, wherein the striking plate comprises a base portion and plurality of hinge features, wherein the plurality of hinge features are arranged in an arc-shaped pattern that extends from a toe side of the strike plate to a heel side of the striking plate along the y-axis, wherein the arc-shaped pattern has a radius of no less than 0.900 inch and no more than 1.500 inch, wherein each of the hinge features plurality of hinge features comprises a stem portion that extends from the base portion at an angle of no less than 45° and no more than 90° with respect to the base portion, and a tab portion that is spaced from the base portion by the stem portion and extends from the stem portion approximately parallel with the base portion without making contact with the base portion, and wherein each tab portion is at least partially disposed over a through-hole extending through the striking plate.

In some embodiments, the arc-shaped pattern may be approximately U-shaped and may comprise at least five rows of hinge features. In other embodiments, the arc-shaped pattern may comprise at least six columns of hinge features. In still other embodiments, the arc-shaped pattern may extend no more than 0.750 inch heel-ward or toe-ward from the geometric center measured along the y-axis. In a further embodiment, the arc-shaped pattern may extend no more than 0.500 inches heel-ward or toe-ward from the geometric center measured along the y-axis.

In any embodiments, the arc-shaped pattern may comprise a central column of hinge features, the tab portion of each of which may extend towards the sole portion along the z-axis. In a further embodiment, the arc-shaped pattern may comprise a first set of columns of hinge features disposed heel-ward of the central column, and each of the hinge features of the first set of columns may have a tab portion that extends at an angle of no less than 40° and no more than 85° with respect to the y-axis. In a further embodiment, the first set of columns may comprise three columns. In an alternative embodiment, the first set of columns may comprise a heel-most column, and each of the hinge features of the heel-most column may have a tab portion that extends at an angle of no less than 40° and no more than 70° with respect to the y-axis. In yet another, alternative embodiment, the arc-shaped pattern may comprise a second set of columns of hinge features disposed toe-ward of the central column, and each of the hinge features of the second set of columns may have a tab portion that extends at an angle of no less than 40° and no more than 85° with respect to the y-axis. In any of the embodiments, the radius may be approximately 1.300 inch.

Another aspect of the present invention is a putter comprising a body comprising a top portion, a sole portion, a toe side, a heel side, a rear side, and a face side with a recess, and a face insert comprising a striking plate, a geometric center, and a backing portion, wherein the face insert is disposed within the recess so that at least a portion of the striking plate is exposed, wherein a horizontal y-axis extends in a heel side to toe side direction parallel with the face side and a ground plane, a vertical z-axis extends perpendicular to the y-axis from the sole portion to the top portion through the geometric center, and a horizontal x-axis extends perpendicular to both the y- and z-axes from the face side to the rear side, wherein the striking plate comprises a base portion and plurality of hinge features, wherein each of the hinge features plurality of hinge features comprises a stem portion that extends from the base portion at an angle of no less than 45 degrees and no more than 90 degrees with respect to the base portion, and a tab portion that is spaced from the base portion by the stem portion and extends from the stem portion approximately parallel with the base portion without making contact with the base portion, wherein each tab portion is at least partially disposed over a through-hole extending through the striking plate, wherein the plurality of hinge features are arranged in at least one row extending parallel with the y-axis, wherein each hinge feature in the at least one row has a tab portion with an orientation angle with respect to the y-axis, and wherein the orientation angle of each tab portion of each hinge feature within the at least one row differs from the orientation angle of all other tab portions of the hinge features within the at least one row.

In some embodiments, the at least one row comprises five rows. In a further embodiment, at least two rows of the five rows may have an identical number of hinge features having identical tab portion orientations with respect to the y-axis. In other embodiments, a hinge feature located at a center of each row of the at least one row may have a tab portion that extends approximately perpendicular with the y-axis. In still other embodiments, a hinge feature located at an end of the at least one row may have a tab portion with an orientation angle of no less than 30° and no more than 75°. In another embodiment, the at least one row may comprise a first hinge feature with a tab portion with an orientation angle of approximately 45° and a second hinge feature with a tab portion with an orientation angle of approximately −45°. In a further embodiment, the orientation angle of each of the tab portion of the hinge features located on either side of the central hinge feature may gradually decrease heel-ward and toe-ward.

In any of the embodiments, the striking plate may be composed of steel and the backing may be composed of injection-molded urethane. In any of the embodiments, each of the first and second hinge features may be spaced from the geometric center by no less than 0.250 inch and no more than 0.750 inch measured along the y-axis. In some embodiments, each of the first and second hinge features may be spaced from the geometric center by approximately 0.500 inch measured along the y-axis.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
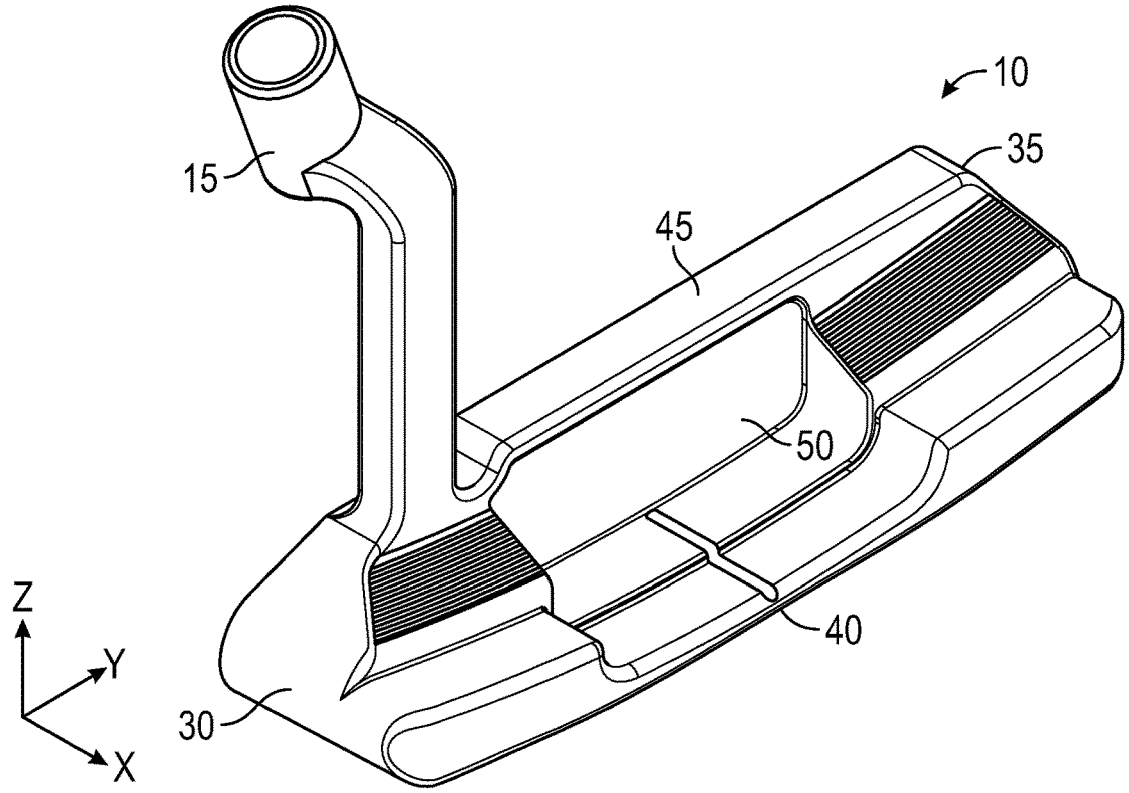
FIG. 1 is a rear perspective view of a putter head sized to receive any of the face inserts of the present invention.

Each embodiment of the present invention is directed to a face insert 100 for a golf club head, preferably a putter head 10, which provides consistent ball speed and improved spin across the striking surface. FIG. 1 shows an exemplary putter head 10, which would benefit from any of the embodiments of the face insert 100 of the present invention. The putter head 10 preferably comprises a hosel 15, a face 20 with a recess 22 sized to receive the face insert 100 of the present invention, a heel side 30, a toe side 35, a sole portion 40, a top portion 45, and a rear portion 50 opposite the face 20. A coordinate system is defined by a vertical z-axis extending from the sole portion 40 to the top portion 45 through the geometric center 25 of the face 20, a y-axis extending in a heel-to-toe direction parallel with the face 20 perpendicular to the z-axis, and an x-axis extending perpendicular to both the y- and z-axes from the face 20 to rear portion 50.

Figure 9:
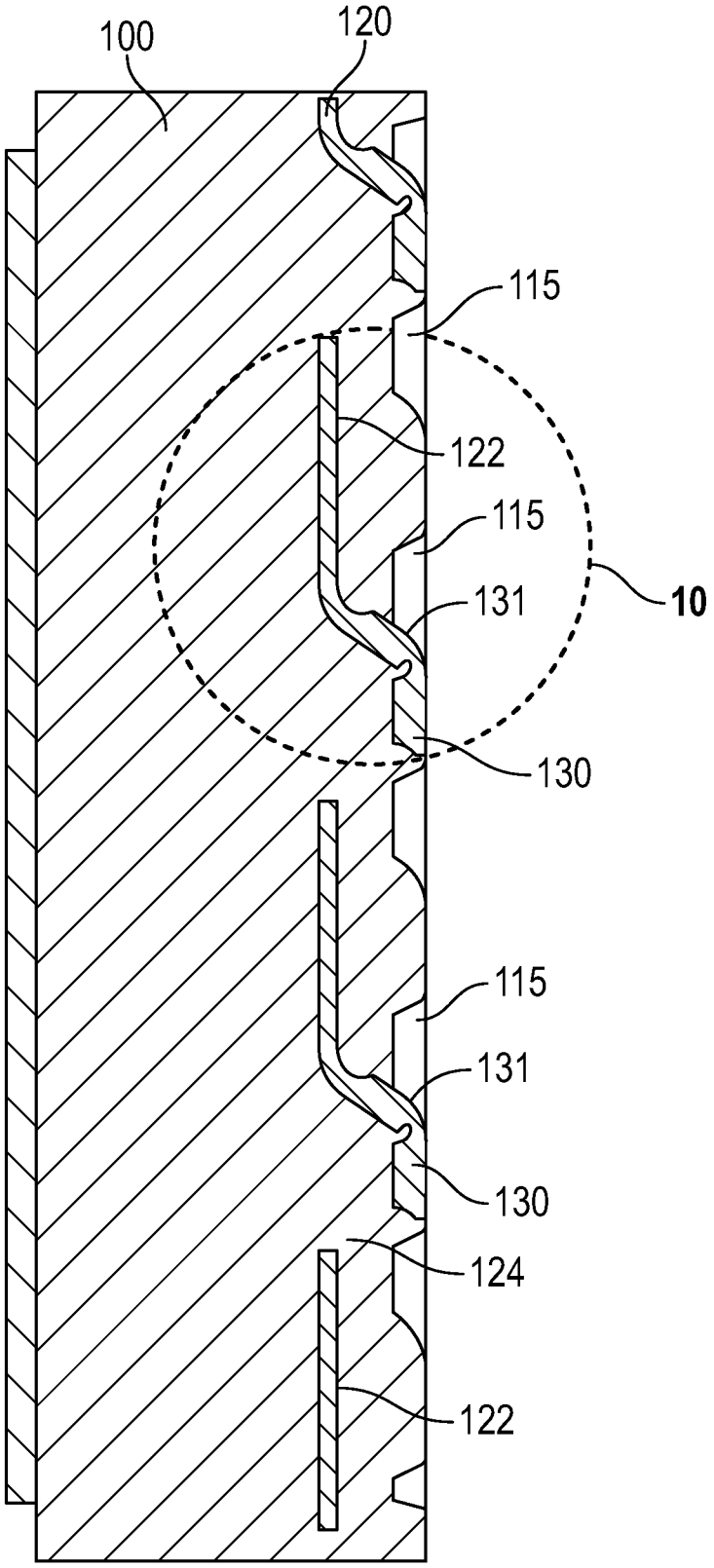
FIG. 9 is a cross-sectional view of the embodiment shown in FIG. 3 along lines 9-9.
Figure 10:
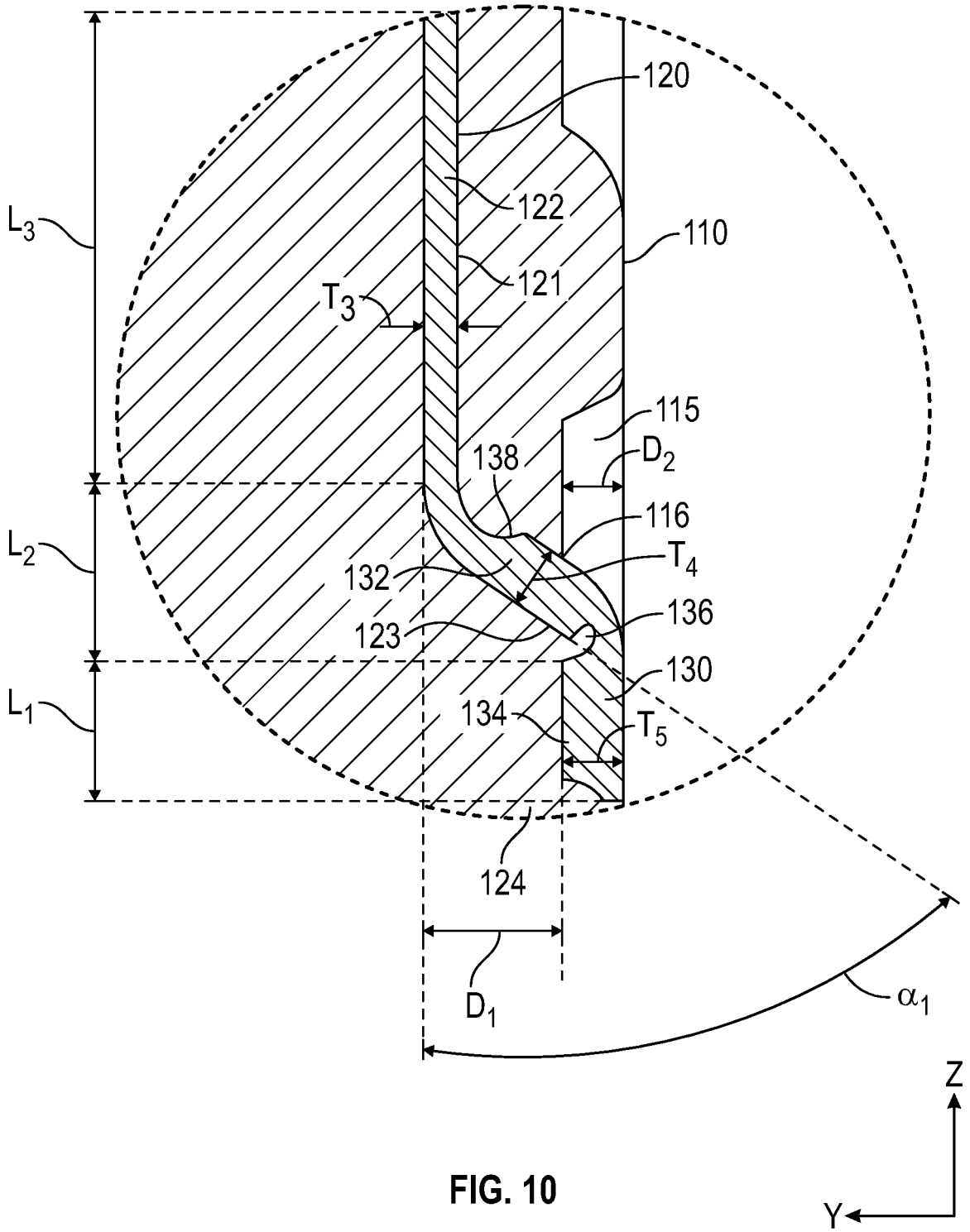
FIG. 10 is an enlarged view of the circled portion of the embodiment shown in FIG. 9.
Figure 11:
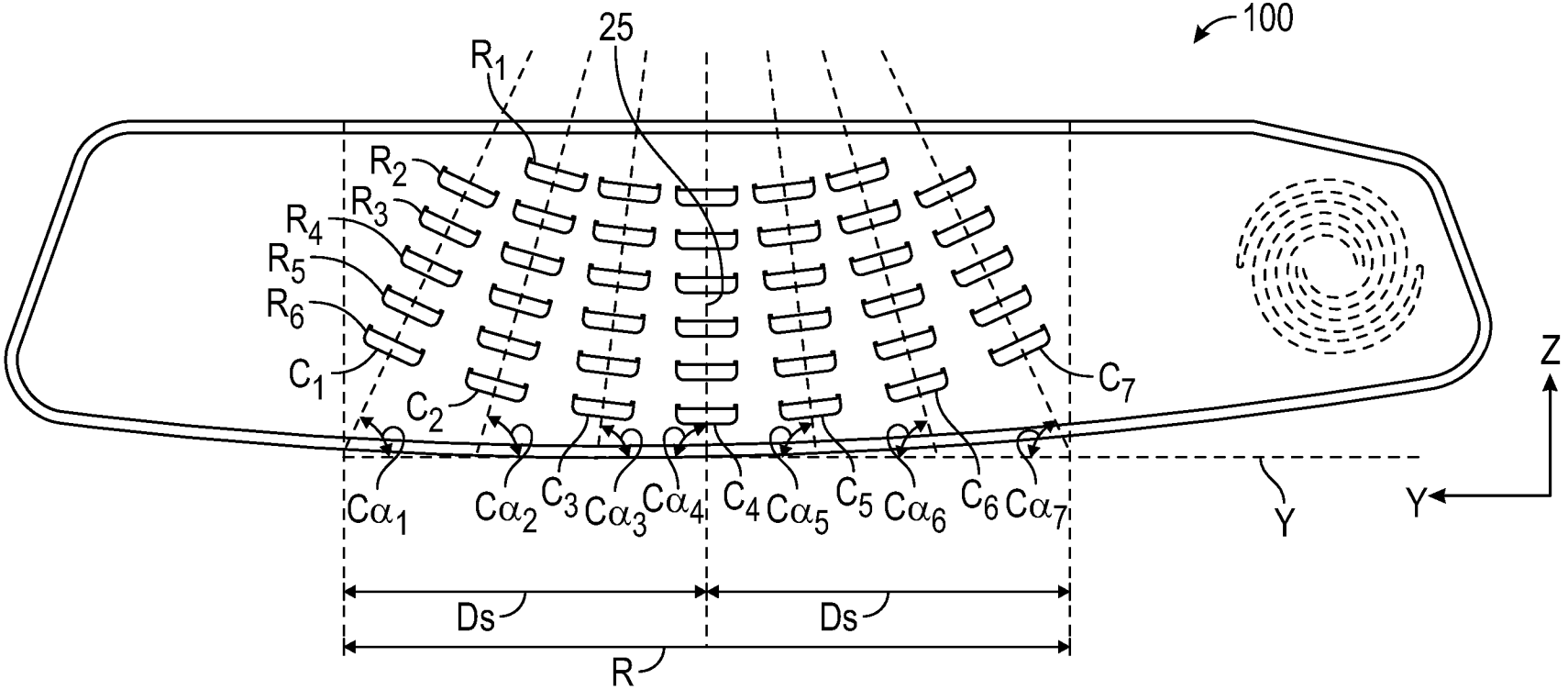
FIG. 11 is front plan view of a third embodiment of the face insert of the present invention.
Figure 12:
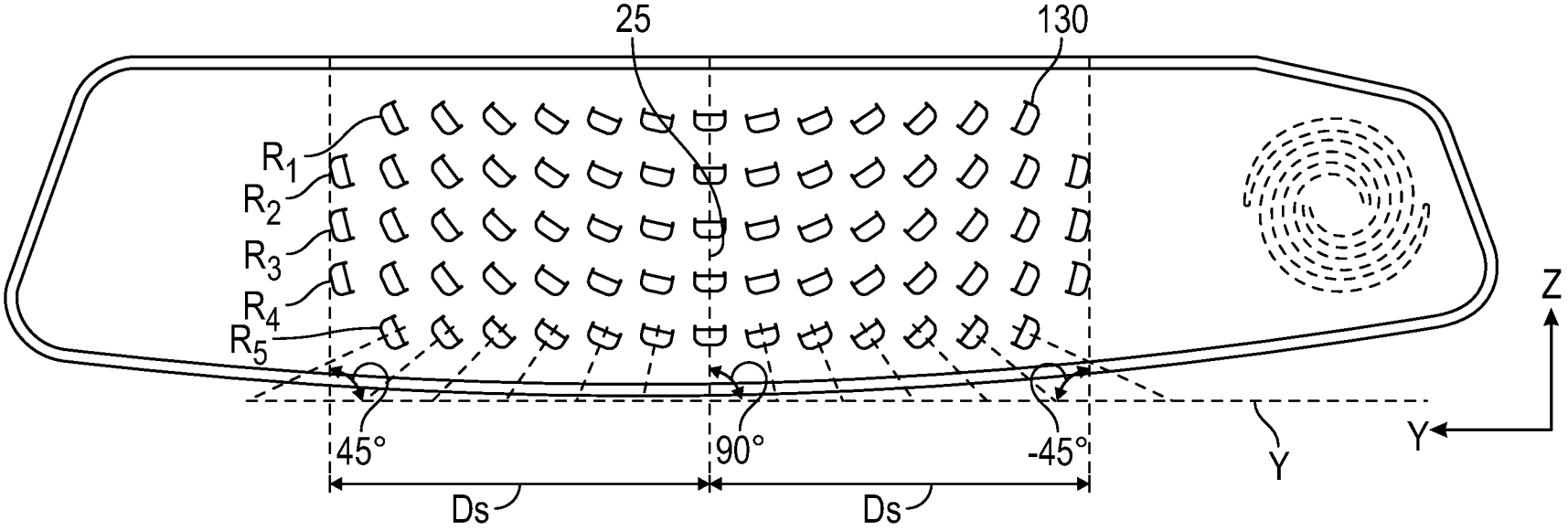
FIG. 12 is a front plan view of a fourth embodiment of the face insert of the present invention.

First and second embodiments of the present invention are shown in FIGS. 2-10, a third embodiment is shown in FIG. 11, and a fourth, preferred embodiment is shown in FIG. 12. In these embodiments, the face insert 100 comprises two parts: a backing portion 110 with a plurality of parallel grooves 115 extending along the y-axis in a heel-to-toe direction, and a thin striking plate 120 comprising a planar base portion 122 with a plurality of through-holes 124 and a plurality of hinge features 130.

As shown in FIGS. 9-10, each hinge feature 130 comprises a stem portion 132 that is connected to, and extends at an angle $\alpha 1$ of 45-90° (most preferably approximately 57°) away from, the base portion 122, and a tab portion 134 that is spaced from an inner surface 123 of the base portion 122 a distance $D_1$ of 0.030 inch to 0.060 inch (most preferably approximately 0.40 inch) along the x-axis and extends away from the stem portion 132 and parallel with the base portion 122 along the z-axis. A first notch 136 extends into the inner surface 123 of the hinge feature 130 at the intersection between the stem portion 132 and the tab portion 134, and a second notch 138 extends into the outer surface 121 of the hinge feature 130 at the intersection between the base portion 122 and the stem portion 132. As shown in FIG. 10, each tab portion 134 preferably is disposed over a through-hole 124.

Each tab portion 134 has a top-to-bottom length $L_1$ along the z-axis ranging from 0.020 to 0.075 inch, and more preferably approximately 0.047 inch, a heel-to-toe (y-axis) width $W_1$ that is greater than $L_1$, and more preferably at least 1.5 times $L_1$, and a thickness $T_5$ of 0.010 to 0.040 inch, more preferably approximately 0.020 inch. The base portion 122 of the striking plate 120 preferably has a thickness $T_3$ of 0.005 to 0.030 inch, more preferably approximately 0.011 inch, and an average vertical length L3 along the z-axis of 0.100 to 0.200 inch, more preferably approximately 0.150 inch. The stem portion 132 has a thickness of $T_4$ of 0.010 to 0.040, more preferably approximately 0.021 inch, and an average vertical length $L_2$ along the z-axis of 0.025 to 0.075 inch, and more preferably approximately 0.056 inch.

Figure 2:
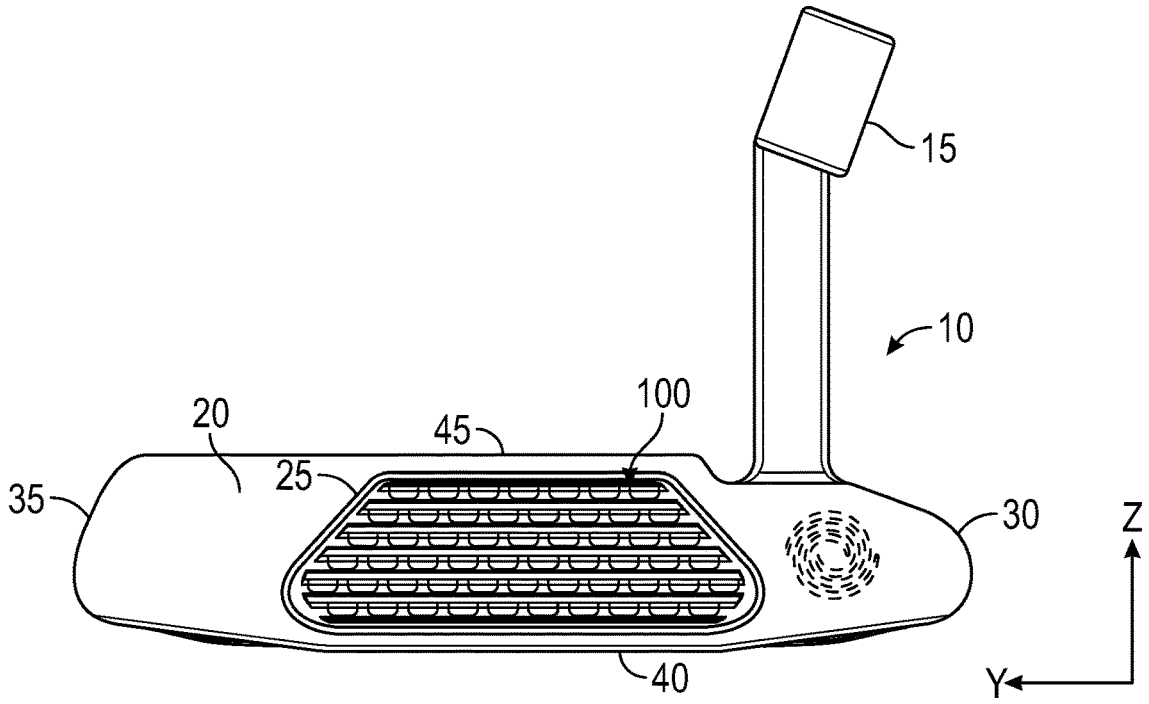
FIG. 2 is a front elevational view of the putter head shown in FIG. 1 with a first embodiment of the face insert of the present invention.
Figure 3:
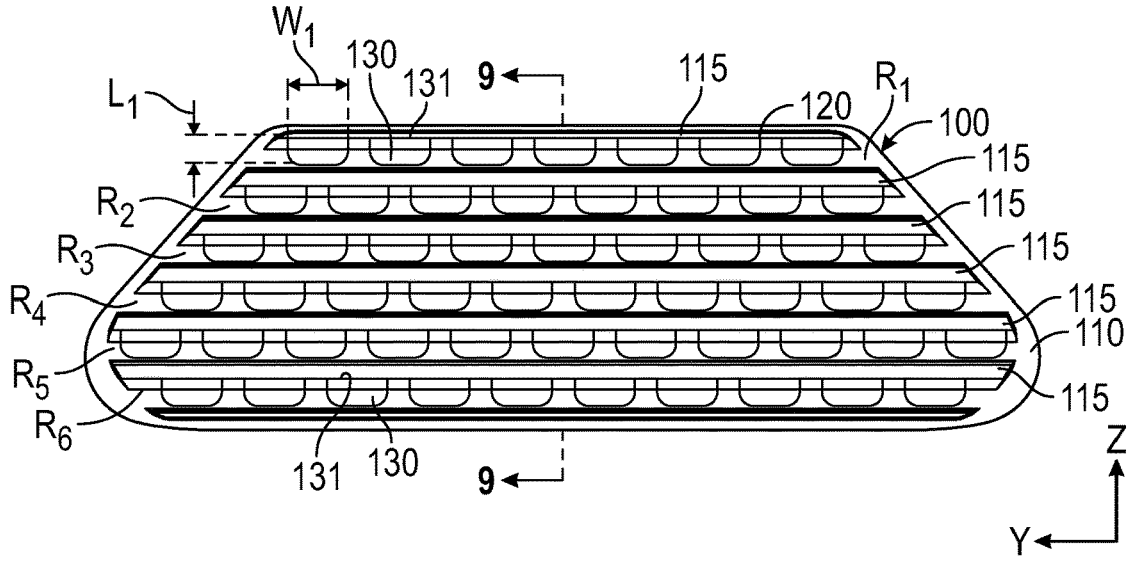
FIG. 3 is a front plan view of the face insert shown in FIG. 2.

FIGS. 9-10 illustrate how the striking plate 120 and backing portion 110 engage with one other, with the grooves 115 disposed above the tab portions 134 along the z-axis, and the backing portion 110 filling the through-holes 124 underneath the tab portions 134 in the striking plate 120. The backing portion 110 also covers the planar base portion 122 so that the upper surface 135 of each tab portion 134, and each of the grooves 115, is exposed and can connect with a golf ball. The stem portion 132 of each hinge feature 130 extends through the backing portion 110 proximate a lower edge 116 of a groove 115, so that the hinge features 130 are aligned with one another along the one or more grooves 115. Each of the grooves has a depth $D_2$ that is at least as great as (or, in other embodiments, approximately equivalent to) the thickness $T_5$ of the tab portion 134. As shown in FIGS. 2-3, the face insert 100 has six rows $R_{1-6}$ of hinge features 130, the upper edges 131 of each of which align with a groove 115 in the backing portion 110. Each hinge feature 130 in a row R is preferably spaced from adjacent hinge features in the row by a distance of 0.010 to 0.075 inch, more preferably 0.020 to 0.060 inch.

When contacted by a golf ball, the tab portions 134 are compressed inwards towards the backing portion 110 and the base portion 122, and provide the face insert 100 with improved elasticity, improving the topspin imparted to the golf ball. The first and second notches 136, 138 improve the bending properties of the tab portions 134, allowing them to flex inwards and outwards more easily. The grooves 115 in the backing portion 110 also contribute to improved spin imparted to the golf ball.

Figure 4:
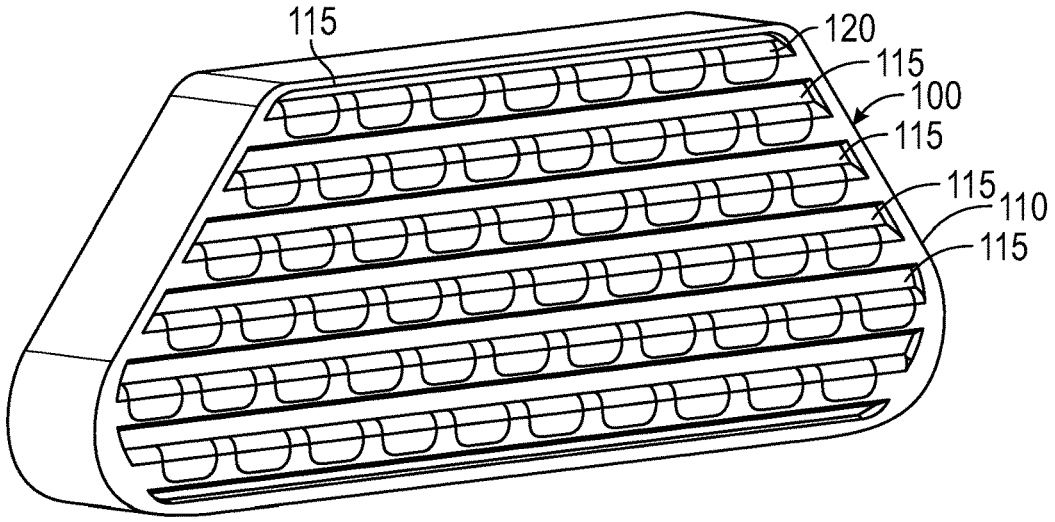
FIG. 4 is a front perspective view of the face insert shown in FIG. 3.
Figure 5:
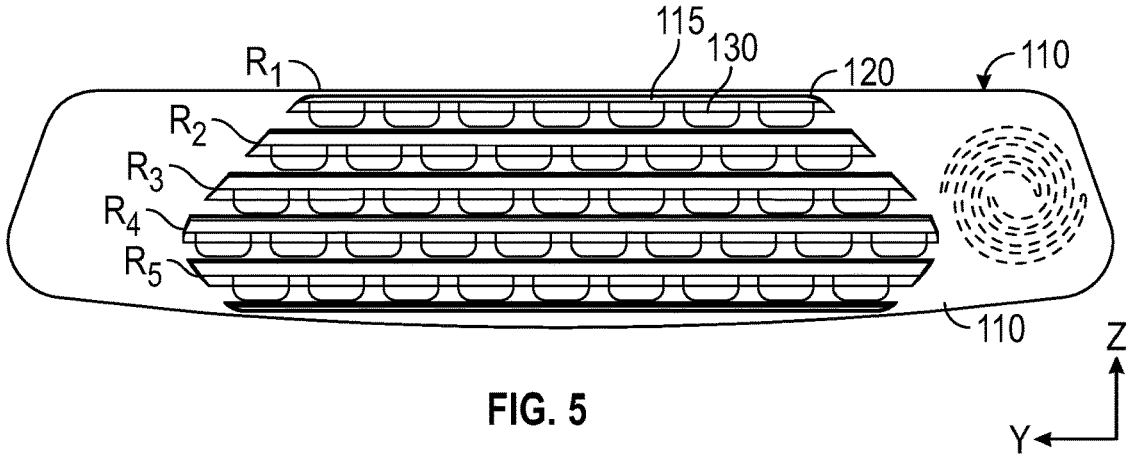
FIG. 5 is a front plan view of a second embodiment of the face insert of the present invention.
Figure 6:
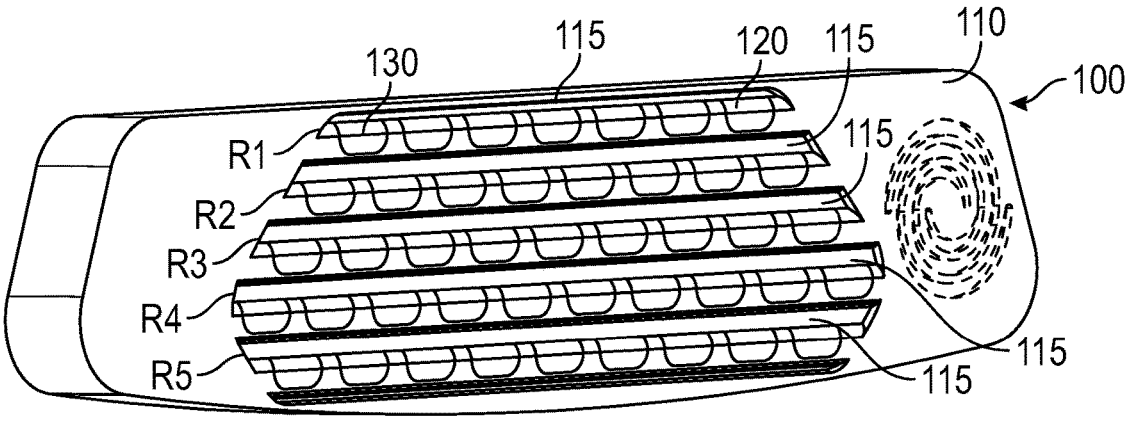
FIG. 6 is a front perspective view of the face insert shown in FIG. 5.
Figure 7:
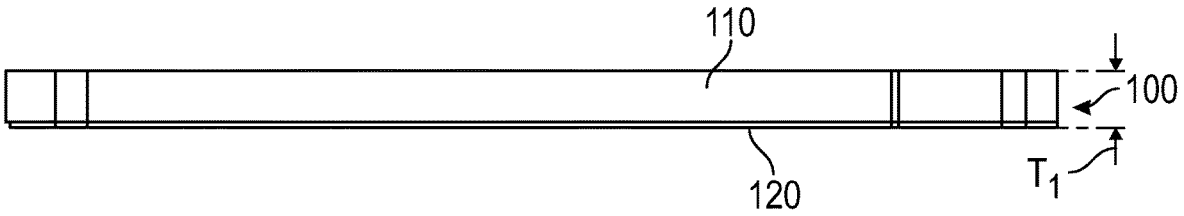
FIG. 7 is a side plan view of the face insert shown in FIG. 3.
Figure 8:
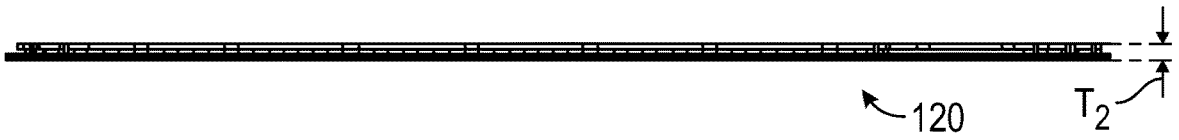
FIG. 8 is a side plan view of the striking plate shown in FIG. 3.

In the first embodiment, the backing portion 110 has the same approximate, trapezoidal shape and z-axis length and y-axis width dimensions as the striking plate 120, while in the second embodiment shown in FIGS. 4-5, the backing portion 110 has significantly larger z-axis length and y-axis width dimensions than the striking plate 120. In each of the embodiments, the backing portion 110 has a significantly larger thickness (measured along the x-axis) than that of the striking plate 120. As shown in FIGS. 7 and 8, the striking plate 120 has an average thickness $T_2$ that is less than 25% of the overall, average thickness $T_1$ of the face insert 100. Each of the embodiments of the face inserts 100 disclosed herein preferably has at least five rows $R_{1-5}$ of hinge features 130, with at least twenty-five hinge features 130 extending from the striking plate 120 and embedded within the backing portion 110.

As shown in the first and second embodiments herein, all of the hinge features 130 can be oriented such that each tab portion 134 extends away from the stem portion 132 along the z-axis towards the sole portion 40; in other words, each tab portion 135 extends perpendicular to the y-axis. It is preferable, however, for the orientation of the tab portions 134 with respect to the y-axis to vary across the face insert 100 to better control the spin imparted to a golf ball impacted at different locations on the face insert 100.

For example, as shown in FIG. 11, the face insert 100 of the third embodiment has six rows $R_1$-$R_6$ of hinge features 130 that extend along the face in an arc-shaped pattern with a radius ranging from 0.900 inch to 1.50 inches, and preferably approximately 1.30. The arc-shaped pattern, which approximates the shape of a "U", is preferably contained within a region R of 1.50 inch, measured heel-ward and toe-ward along the y-axis, of the geometric center 25, and more preferably within a distance $D_S$ of 0.500 inch on each side (heel-ward and toe-ward) of the geometric center 25. Each hinge feature 130 in a row $R_1$-$R_6$ has a different tab portion 134 orientation from the other hinge features 130 in that row $R_1$-$R_6$ with respect to the y-axis. The rows $R_1$-$R_6$ line up such that the hinge features 130 form columns $C_1$-$C_7$, with the tab portion 134 of each hinge feature 130 in a column $C_1$-$C_7$ having the same orientation as the other tab portions 134 in that column $C_1$-$C_7$ with respect to the y-axis.

As shown in FIG. 11, the toe-most column $C_1$ has hinge features 130 with tab portions 134 having an angle orientation $C_{\alpha 1}$ of 50-70°, more preferably 65°, the second heel-most column $C_2$ has hinge features 130 with tab portions 134 having an angle orientation Cat of 65-80°, more preferably 75°, the third heel-most column $C_3$ has hinge features 130 with tab portions 134 having an angle orientation $C_{\alpha 3}$ of 75-85°, more preferably 82°, and the central column $C_4$ has hinge features 130 with tab portions 134 having an angle orientation $C_{\alpha 4}$ of approximately 90°. The columns $C_{5-7}$ on the heel-ward side of the central column $C_4$ have hinge features 130 oriented at mirror image angles of the toe-ward side columns $C_{1-3}$ across the z-axis.

The curvature of the rows $R_1$-$R_6$ of hinge features 130 addresses sidespin and putts that are angled offline away from the geometric center 25. The curved configuration reduces sidespin on mishits to provide more of a "true roll" or topspin toward the intended target, and uses the launch benefit provided by the hinges to move mishits back towards the intended target line. The angled curvature of the rows $R_1$-$R_6$ adjusts for the typical movement, when a ball hit on the toe side will move towards the right, while a ball struck on the heel side will move toward the left.

A preferred embodiment of the present invention is shown in FIG. 12. In this embodiment, the hinge features 130 are arranged in a series of horizontal rows $R_1$-$R_5$ extending parallel with the y-axis. As with the embodiment shown in FIG. 11, each of the tab portions 134 of the hinge features 130 in a given row $R_1$-$R_5$ have different orientations with respect to the y-axis from all other tab portions 134 in that row $R_1$-$R_5$. This preferred embodiment includes five rows $R_1$-$R_5$, each of which includes a central hinge feature 130 with a tab portion 134 approximately aligned with the geometric center 25 along the y-axis, and a plurality of hinge features 130 arrayed on either side of the central hinge feature 130. The angle, measured with respect to the y-axis, of each tab portion 134 of the hinge features 130 located on either side of the central hinge feature 130 gradually decreases heel-ward and toe-ward, such that the hinge features 130 on the heel- and toe-most sides of the central hinge feature 130 have tab portions that extend at an angle of approximately −45° and 45°, respectively. These opposing, end-most hinge features 130 are spaced from the geometric center 25 along the y-axis by a distance $D_S$ of no less than 0.250 inch, and more preferably approximately 0.500 inch. As shown in FIG. 12, at least two of the rows (e.g., $R_1$ and $R_5$) include the same number of hinge features 130, each with the same tab portion 134 orientations.

The hinge features 130 shown in FIGS. 11 and 12 provide a starting line benefit of up to 0.5° in either a right or left direction, and add at least 25 rpm of topspin to a putt. Angling the hinge features 130 as shown in FIGS. 11-12 changes side spin by up to 25 rpm in either the hook or fade direction, depending on the severity of the angle (up to 90 degrees).

The striking plate 120 preferably is composed of a metal alloy material such as stainless steel, titanium alloy, or aluminum alloy, though it may be composed of a rigid polymer material in alternative embodiments. When the striking plate 120 is composed of a metal alloy, the hinge features 130 and through-holes 124 may be stamped, chemical etched, machined, and/or otherwise added to the striking plate 120 by any means known to a person skilled in the art. The backing portion 110 preferably is composed of a polymer such as urethane, and preferably is co-molded or injection molded onto the striking plate 120 so that the polymer material can flow over portions of the striking plate 120, specifically the base portion 122, and into the through-holes 124 underneath the tab portions 134. In alternative embodiments, however, the backing portion 110 may be permanently attached to the striking plate 120 with an adhesive.

Though each of the face insert 100 embodiments disclosed herein are shown in connection with a putter head 10, these embodiments may be used with any other golf club head, including drivers, fairway woods, irons, wedges, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a top portion, a sole portion, a toe side, a heel side, a rear side, and a face side with a recess; and a face insert comprising a striking plate and a geometric center, wherein the face insert is disposed within the recess so that at least a portion of the striking plate is exposed, wherein a horizontal y-axis extends in a heel side to toe side direction parallel with the face side and a ground plane, a vertical z-axis extends perpendicular to the y-axis from the sole portion to the top portion through the geometric center, and a horizontal x-axis extends perpendicular to both the y- and z-axes from the face side to the rear side, wherein the striking plate comprises a base portion and a plurality of hinge features, wherein the plurality of hinge features are arranged in an arc-shaped pattern that extends from a toe side of the strike plate to a heel side of the striking plate along the y-axis, wherein the arc-shaped pattern has a radius of no less than 0.900 inch and no more than 1.500 inches, wherein each hinge feature of the plurality of hinge features comprises a stem portion that extends from the base portion at an angle of no less than 45° and no more than 90° with respect to the base portion, and a tab portion that is spaced from the base portion by the stem portion and extends from the stem portion approximately parallel with the base portion without making contact with the base portion, and wherein each tab portion is at least partially disposed over a through-hole extending through the striking plate.

2. The golf club head of claim 1, wherein the arc-shaped pattern is approximately U-shaped and comprises at least five rows of hinge features.

3. The golf club head of claim 1, wherein the arc-shaped pattern comprises at least six columns of hinge features.

4. The golf club head of claim 1, wherein the arc-shaped pattern extends no more than 0.750 inch heel-ward or toe-ward from the geometric center measured along the y-axis.

5. The golf club head of claim 4, wherein the arc-shaped pattern extends no more than 0.500 inch heel-ward or toe-ward from the geometric center measured along the y-axis.

6. The golf club head of claim 1, wherein the arc-shaped pattern comprises a central column of hinge features, the tab portion of each of which extends towards the sole portion along the z-axis.

7. The golf club head of claim 6, wherein the arc-shaped pattern comprises a first set of columns of hinge features disposed heel-ward of the central column, and wherein the tab portion of each of the hinge features of the first set of columns extends at an angle of no less than 40° and no more than 85° with respect to the y-axis.

8. The golf club head of claim 7, wherein the first set of columns comprises three columns.

9. The golf club head of claim 7, wherein the first set of columns comprises a heel-most column, and wherein the tab portion of each of the hinge features of the heel-most column extends at an angle of no less than 40° and no more than 70° with respect to the y-axis.

10. The golf club head of claim 7, wherein the arc-shaped pattern comprises a second set of columns of hinge features disposed toe-ward of the central column, and wherein the tab portion of each of the hinge features of the second set of columns extends at an angle of no less than 40° and no more than 85° with respect to the y-axis.

11. The golf club head of claim 1, wherein the radius is approximately 1.300 inches.

12. A golf club head comprising:

a body comprising a top portion, a sole portion, a toe side, a heel side, a rear side, and a face side with a recess; and a face insert comprising a striking plate and a geometric center, wherein the face insert is disposed within the recess so that at least a portion of the striking plate is exposed, wherein a horizontal y-axis extends in a heel side to toe side direction parallel with the face side and a ground plane, a vertical z-axis extends perpendicular to the y-axis from the sole portion to the top portion through the geometric center, and a horizontal x-axis extends perpendicular to both the y- and z-axes from the face side to the rear side, wherein the striking plate comprises a base portion and plurality of hinge features, wherein each hinge feature of the plurality of hinge features comprises a stem portion that extends from the base portion at an angle of no less than 45 degrees and no more than 90 degrees with respect to the base portion, and a tab portion that is spaced from the base portion by the stem portion and extends from the stem portion approximately parallel with the base portion without making contact with the base portion, wherein each said tab portion is at least partially disposed over a through-hole extending through the striking plate, wherein the plurality of hinge features are arranged in at least one row extending parallel with the y-axis, wherein the tab portion of each hinge feature in the at least one row has an orientation angle with respect to the y-axis, and wherein the orientation angle of each said tab portion of each hinge feature within the at least one row differs from the orientation angle of all other said tab portions of the hinge features within the at least one row.

13. The golf club head of claim 12, wherein the at least one row comprises five rows.

14. The golf club head of claim 13, wherein at least two rows of the five rows have an identical number of hinge features having identical tab portion orientations with respect to the y-axis.

15. The golf club head of claim 12, wherein the tab portion of a hinge feature located at a center of each row of the at least one row approximately perpendicular with the y-axis.

16. The golf club head of claim 12, wherein the tab portion of a hinge feature located at an end of the at least one row has an orientation angle of no less than 30° and no more than 75°.

17. The golf club head of claim 16, wherein each of the first and second hinge features is spaced from the geometric center by no less than 0.250 inch and no more than 0.750 inch measured along the y-axis.

18. The golf club head of claim 16, wherein the orientation angle of each tab portion of the hinge features located on either side of the central hinge feature gradually decreases heel-ward and toe-ward.

19. The golf club head of claim 12, wherein the at least one row comprises a first hinge feature and a second hinge feature, wherein the tab portion of the first hinge feature has an orientation angle of approximately 45°, and wherein the tab portion of the second hinge feature has an orientation angle of approximately −45°.

20. The golf club head of claim 19, wherein each of the first and second hinge features is spaced from the geometric center by approximately 0.500 inch measured along the y-axis.

* * * * *